US005386744A

United States Patent [19]

Garcia

[11] Patent Number: 5,386,744

[45] Date of Patent: Feb. 7, 1995

[54] BROKEN BULB REMOVAL TOOL

[76] Inventor: Alfredo M. Garcia, 1220 Magnolia, Rantoul, Ill. 61866

[21] Appl. No.: 138,724

[22] Filed: Oct. 20, 1993

[51] Int. Cl.[6] ..... H01K 3/32

[52] U.S. Cl. ..... 81/53.11; 81/302; 81/423

[58] Field of Search ..... 81/302, 423, 53.1, 53.11, 81/53.12; 29/229, 243.56

[56] References Cited

U.S. PATENT DOCUMENTS 2,364,953 12/1944 Daley ..... 81/302 X 3,132,550 5/1964 Sion ..... 81/423

FOREIGN PATENT DOCUMENTS 22103 of 1911 United Kingdom ..... 81/53.11

*Primary Examiner*—James G. Smith

*Attorney, Agent, or Firm*—E. Michael Combs

[57] ABSTRACT

A scissor-like member is arranged to include cooperative arcuate jaws arranged to secure and receive a central bulb element therewithin for its grasping and rotation to remove the central bulb relative to an associated socket.

2 Claims, 4 Drawing Sheets

FIG. 5
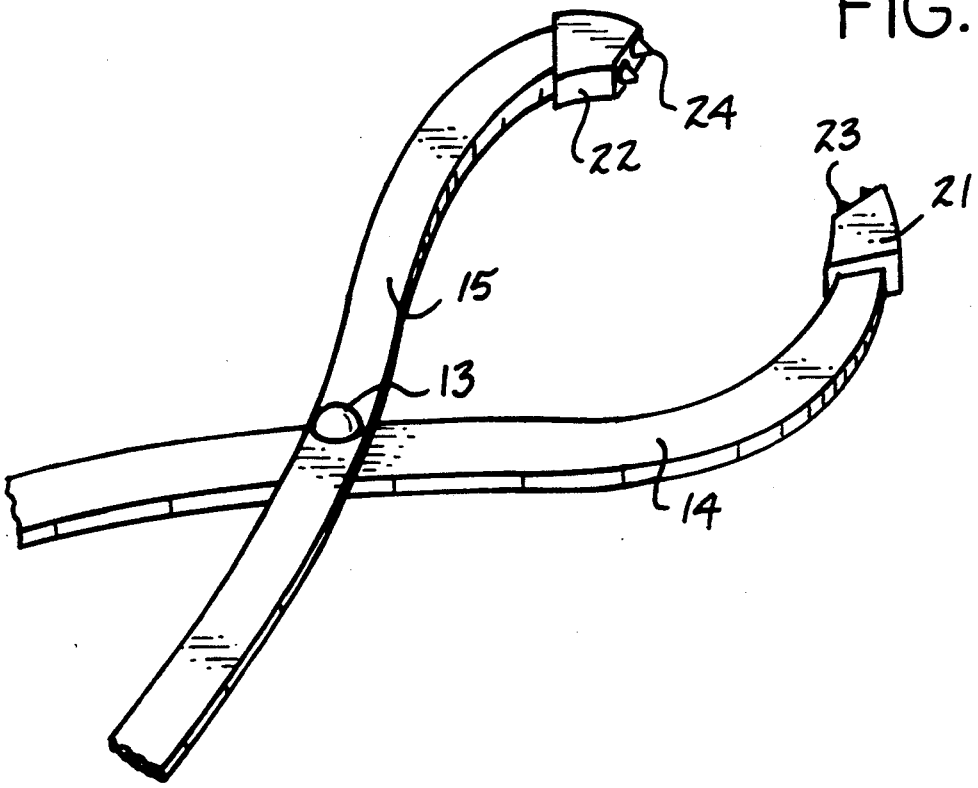
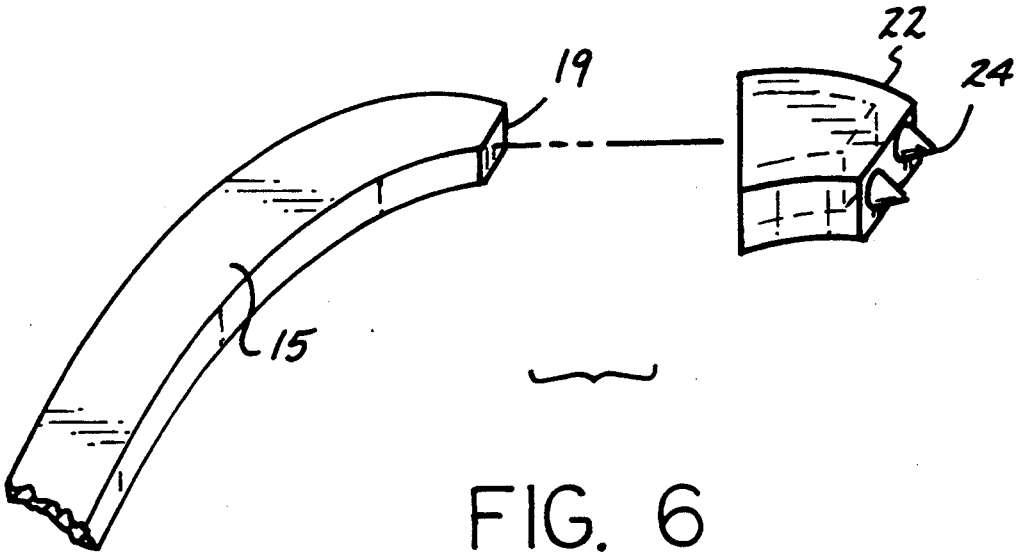
FIG. 6

FIG. 7
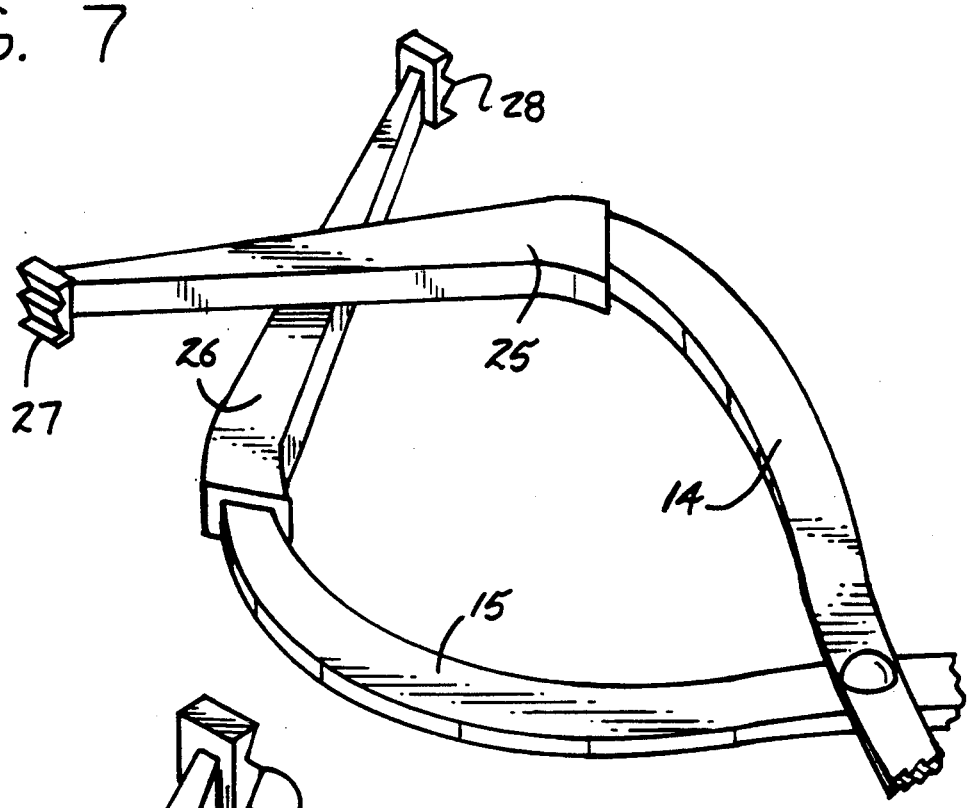
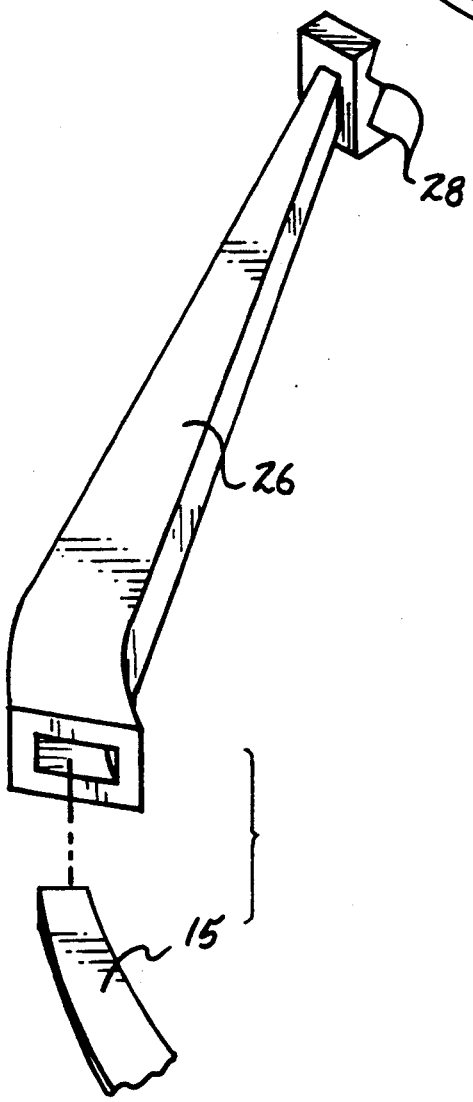
FIG. 8

BROKEN BULB REMOVAL TOOL

BACKGROUND OF THE INVENTION

1. Field of the Invention

The field of invention relates to clamping structure, and more particularly pertains to a new and improved broken bulb removal tool permitting ease of grasping of a broken bulb within a socket to enhance its removal relative to the socket.

2. Description of the Prior Art

Light bulb changing apparatus is indicated in the prior art in U.S. Pat. No. 4,663,996, as well as U.S. Pat. No. 5,103,695.

The instant invention attempts to overcome deficiencies of the prior art by providing for a scissor-like clamping structure arranged to grasp a broken bulb to ease its removal relative to its socket and in this respect, the present invention substantially fulfills this need.

SUMMARY OF THE INVENTION

In view of the foregoing disadvantages inherent in the known types of clamping tool structure now present in the prior art, the present invention provides a broken bulb removal tool wherein a scissor-like tool member is arranged to permit clamping of a broken bulb base within its socket. As such, the general purpose of the present invention, which will be described subsequently in greater detail, is to provide a new and improved broken bulb removal tool which has all the advantages of the prior art broken bulb removal apparatus and none of the disadvantages.

To attain this, the present invention provides a scissor-like member arranged to include cooperative arcuate jaws arranged to secure and receive a central bulb element therewithin for its grasping and rotation to remove the central bulb relative to an associated socket.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved broken bulb removal tool which has all the advantages of the prior art broken bulb removal apparatus and none of the disadvantages.

It is another object of the present invention to provide a new and improved broken bulb removal tool which may be easily and efficiently manufactured and marketed.

It is a further object of the present invention to provide a new and improved broken bulb removal tool which is of a durable and reliable construction.

An even further object of the present invention is to provide a new and improved broken bulb removal tool which is susceptible of a low cost of manufacture with regard to both materials and labor, and which accordingly is then susceptible of low prices of sale to the consuming public, thereby making such broken bulb removal tools economically available to the buying public.

Still yet another object of the present invention is to provide a new and improved broken bulb removal tool which provides in the apparatuses and methods of the prior art some of the advantages thereof, while simultaneously overcoming some of the disadvantages normally associated therewith.

These together with other objects of the invention along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric illustration of the invention further employing respective sleeve members.

FIG. 6 is an enlarged isometric illustration of the sleeve arranged in a separated orientation relative to a respective jaw member.

FIG. 7 is an isometric illustration of the invention employing elongate sleeves.

FIG. 8 is an isometric illustration of the elongate sleeve structure arranged for mounting to an associated jaw member.

DESCRIPTION OF THE PREFERRED EMBODIMENT

Figure 1:
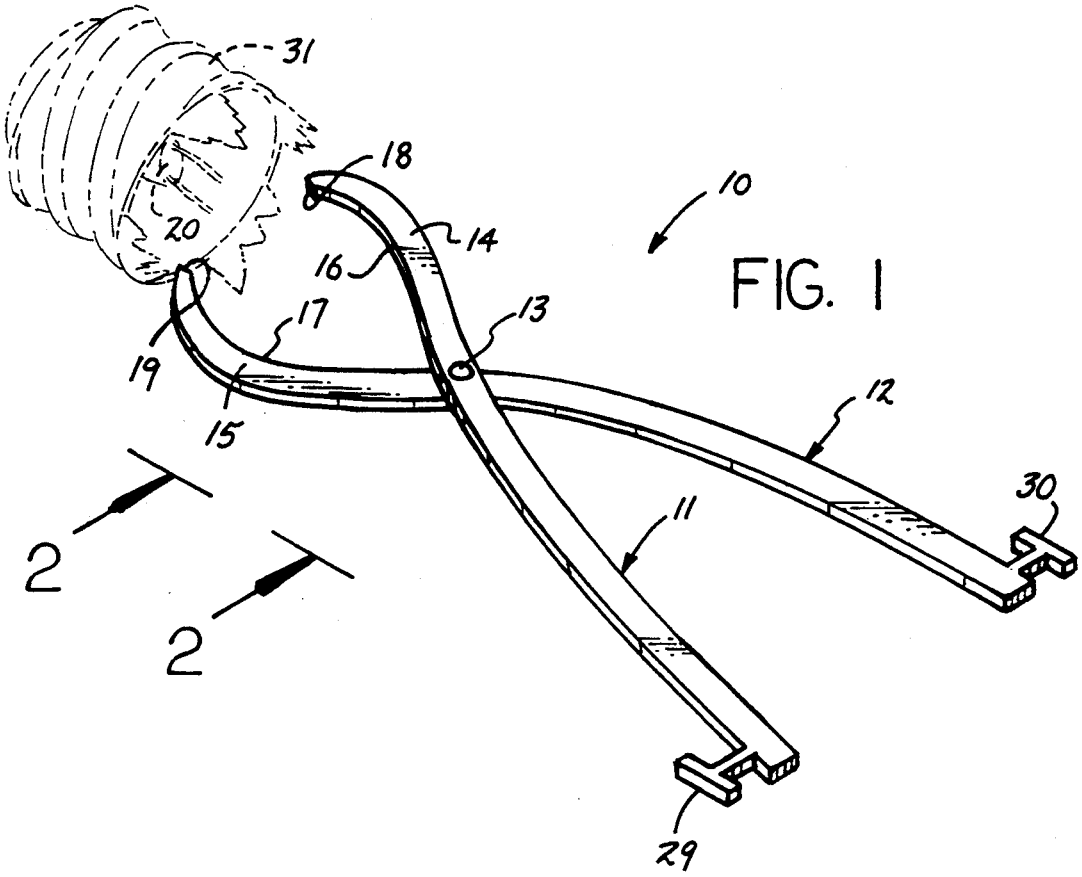
FIG. 1 is an isometric illustration of the invention.
Figure 2:
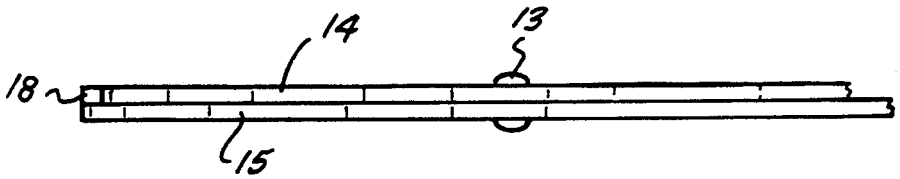
FIG. 2 is an orthographic view, taken along the lines 2—2 of FIG. 1 in the direction indicated by the arrows.

With reference now to the drawings, and in particular to FIGS. 1 to 8 thereof, a new and improved broken bulb removal tool embodying the principles and concepts of the present invention and generally designated by the reference numeral 10 will be described.

More specifically, the broken bulb removal tool 10 of the instant invention essentially includes first and second legs 11 and 12 pivotally mounted in a scissor-like relationship about a pivot axle 13, wherein first and second leg semi-circular jaws 14 and 15 are arranged to a first side of the pivot axle, having facing first and second concave surfaces 16 and 17 respectively terminating in respective first and second tips 18 and 19. In this manner, a central bulb element 20 of a broken bulb base may be clamped by the first and second tips 18 and 19. The first and second legs 11 and 12 at their second ends include respective first and second T-shaped abutments 29 and 30 projecting therefrom in a coplanar relationship relative to the first arid second legs to provide abutment for an individual's fingers positioned between the first and second legs and the first and second T-shaped abutments 29 and 30.

Figure 3:
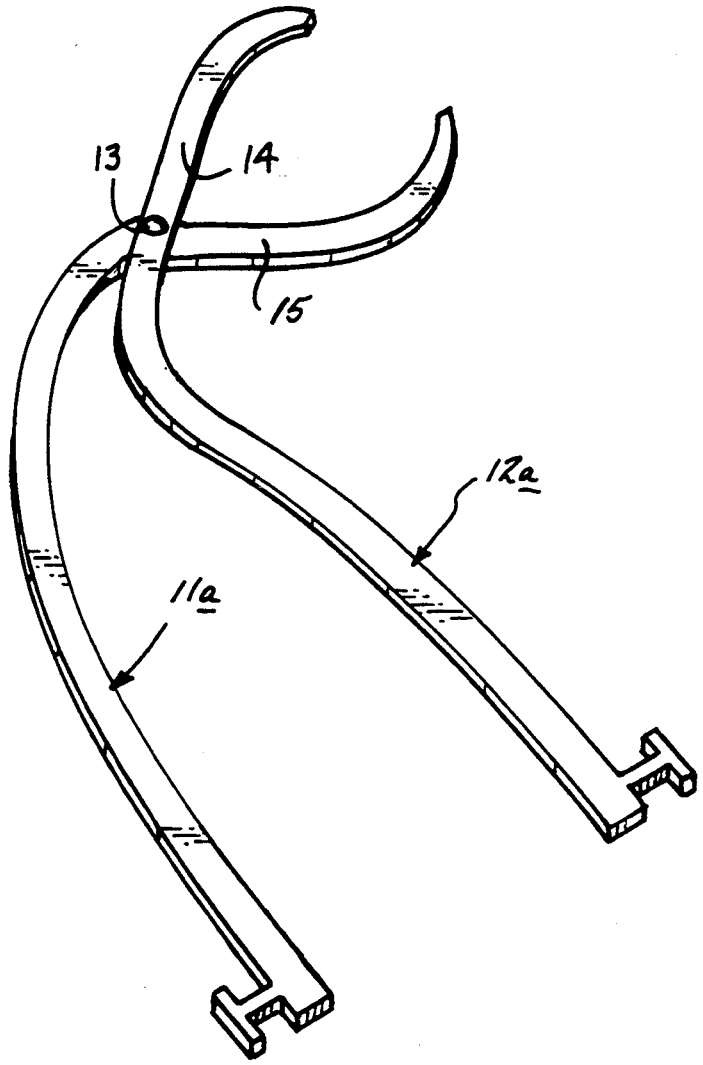
FIG. 3 is an isometric illustration of a modified aspect of the tool structure.
Figure 4:
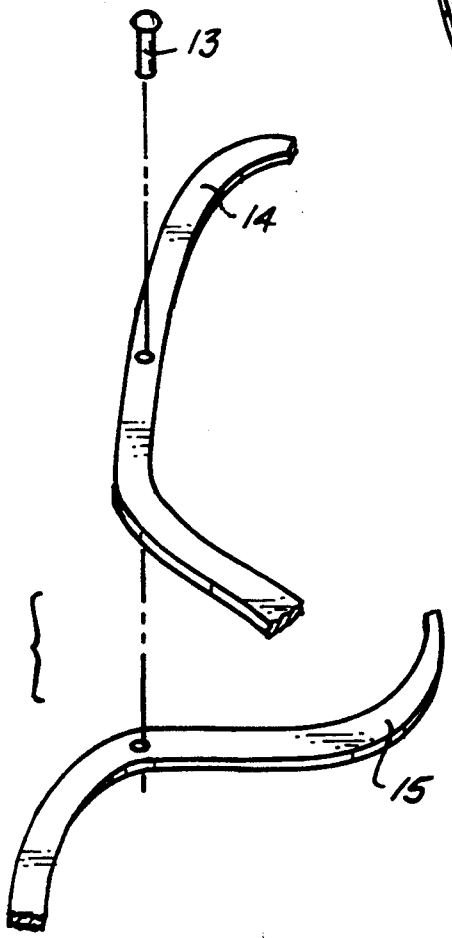
FIG. 4 is an enlarged orthographic view, in exploded illustration, of the jaw structure of FIG. 3.

The FIGS. 3 and 4 indicate that the use of modified first and second legs are provided to orthogonally orient the, first and second jaws relative to the first and second legs to provide for a right angular clamping of the central bulb element 20.

The FIGS. 5 and 6 indicate that respective first and second resilient caps 21 and 22 may be mounted upon the first and second legs 11 and 12 onto the respective first and second tips 18 and 19 of the first and second leg semi-circular jaws 14 and 15 respectively. The first and second caps 21 and 22 include first and second resilient projections 23 and 24 respectively projecting therefrom to enhance clamping of the central bulb element 20.

An alternative type of sleeve structure is indicated in the FIGS. 7 and 8, wherein first and second respective elongate sleeves 25 and 26 extend from the first and second jaws 14 and 15 crossing one another and terminating in respective first and second ribs 27 and 28 to permit clamping of the broken bulb base 31, such that the first and second ribs 27 and 28 engage diametrically opposed sides within the base permitting its clamping by the tool structure and thereby permitting its unthreading relative to its socket.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A broken bulb removal tool, comprising, a first leg and a second leg, having a pivot axle pivotally mounting the first leg to the second leg in a scissor-like relationship, wherein the first leg and the second leg include respective first and second arcuate jaws respectively arranged in a facing relationship relative to one another, having respective first and second concave surfaces, with the first leg arcuate jaw and the second leg arcuate jaw terminating in a respective first tip and second tip and arranged to engage a central bulb element, the first leg includes a first leg second end, and the second leg includes a second leg second end, the first leg second end and the second leg second end include a first abutment and second abutment respectively permitting positioning of an individual's fingers between the first abutment and the first leg and the second abutment and the second leg, with a first resilient elongate sleeve mounted onto the first leg arcuate jaw, and a second elongate sleeve crossing and intersecting the first elongate sleeve, with the second elongate sleeve mounted onto the second leg arcuate jaw.

2. A tool as set forth in claim 1 wherein the first elongate sleeve includes a plurality of first ribs and the second elongate sleeve includes a plurality of second ribs, with the first ribs and second ribs arranged for engaging diametrically opposed sides of a broken bulb base portion.

* * * * *